US011162193B2

(12) United States Patent
Agrawal et al.

(10) Patent No.: US 11,162,193 B2
(45) Date of Patent: Nov. 2, 2021

(54) APPARATUS AND PROCESS FOR UNIFORM DEPOSITION OF POLYMERIC NANOFIBERS ON SUBSTRATE

(71) Applicants: Ashwini Kumar Agrawal, New Delhi (IN); Manjeet Jassal, New Delhi (IN); Dhirendra Singh, Kanpur (IN); Sandip Basu, Kolkata (IN); Deepika Gupta, Gurgaon (IN); Rajeev Kapoor, Gurgaon (IN); Puneet Singla, Gurgaon (IN); Tamal Kanti Bera, Kolkata (IN)

(72) Inventors: Ashwini Kumar Agrawal, New Delhi (IN); Manjeet Jassal, New Delhi (IN); Dhirendra Singh, Kanpur (IN); Sandip Basu, Kolkata (IN); Deepika Gupta, Gurgaon (IN); Rajeev Kapoor, Gurgaon (IN); Puneet Singla, Gurgaon (IN); Tamal Kanti Bera, Kolkata (IN)

(73) Assignee: Indian Institute of Technology Dehi, New Delhi (IN)

( * ) Notice: Subject to any disclaimer, the term of this patent is extended or adjusted under 35 U.S.C. 154(b) by 708 days.

(21) Appl. No.: 16/073,592

(22) PCT Filed: Jan. 25, 2017

(86) PCT No.: PCT/IN2017/050037

§ 371 (c)(1),
(2) Date: Jul. 27, 2018

(87) PCT Pub. No.: WO2017/130220

PCT Pub. Date: Aug. 3, 2017

(65) Prior Publication Data

US 2021/0207291 A1 Jul. 8, 2021

(30) Foreign Application Priority Data

Jan. 27, 2016 (IN) ..... 201611002981

(51) Int. Cl.

| | |
|---|---|
| ***D01D 5/00*** | (2006.01) |
| ***D04H 1/728*** | (2012.01) |
| ***D01D 5/18*** | (2006.01) |

(52) U.S. Cl.
CPC ..... *D01D 5/0069* (2013.01); *D01D 5/0061* (2013.01); *D01D 5/0076* (2013.01);
(Continued)

(58) Field of Classification Search
CPC .. D01D 5/0061; D01D 5/0069; D01D 5/0076; D01D 5/0092; D01D 5/18; D04H 1/728
See application file for complete search history.

(56) References Cited

U.S. PATENT DOCUMENTS

| | | | |
|---|---|---|---|
| 6,991,702 | B2 | 1/2006 | Kim |
| 7,629,030 | B2 | 12/2009 | Robertson et al. |

(Continued)

FOREIGN PATENT DOCUMENTS

| | | | |
|---|---|---|---|
| EP | 1740743 | B1 | 6/2009 |
| WO | 2004016839 | A1 | 2/2004 |

(Continued)

OTHER PUBLICATIONS

Doshi et al., "Electrospinning Process and Applications of Electrospun Fibers", Journal of Electrostatics vol. 35, 1995, pp. 151-160.
Reneker et al., "Nanometre diameter fibres of polymer, produced by electrospinning", Nanotechnology, vol. 7, 1996, United Kingdom, pp. 216-223.

(Continued)

*Primary Examiner* — Xiao S Zhao
*Assistant Examiner* — Joseph S Leyson
(74) *Attorney, Agent, or Firm* — Dinsmore & Shohl, LLP

(57) ABSTRACT

The present invention relates to an apparatus for the mass production of polymeric nanofibres and their uniform deposition over any substrate. The present invention also provides a method for the manufacture of droplet free polymeric nanofibres by electrospinning process using multi-hole spinnerets. The droplet free polymeric nanofibres of the present invention are preferably of a diameter in the range of 50 nm to 850 nm.

18 Claims, 11 Drawing Sheets

(52) U.S. Cl.
CPC ..... *D01D 5/0092* (2013.01); *D01D 5/18* (2013.01); *D04H 1/728* (2013.01)

(56) References Cited

U.S. PATENT DOCUMENTS

| | | | | |
|---|---|---|---|---|
| 7,980,838 | B2 | 7/2011 | Park | |
| 9,685,655 | B2 * | 6/2017 | Wang | H01M 4/139 |
| 2002/0122840 | A1 * | 9/2002 | Lee | D01D 5/0061 425/174.6 |
| 2008/0102145 | A1 | 5/2008 | Kim et al. | |
| 2008/0277836 | A1 | 11/2008 | Park | |
| 2016/0083868 | A1 * | 3/2016 | Park | D01D 5/34 425/174.8 E |

FOREIGN PATENT DOCUMENTS

| | | | |
|---|---|---|---|
| WO | 2005042813 | A1 | 5/2005 |
| WO | 2008036581 | A1 | 3/2008 |
| WO | 2013181559 | A1 | 12/2013 |
| WO | 2014171625 | A1 | 10/2014 |

OTHER PUBLICATIONS

Yarin et al., "Taylor cone and jetting from liquid droplets in electrospinning of nanofibers", Journal of applied Physics, vol. 90, No. 9, 2001, pp. 4836-4846.

Kowalewski et al., "Nanofibres by electro-spinning of polymer solution", Paper presented at The 5th Euromech Fluid Mechanics Conference, Toulouse, France, Aug. 24-28, 2003, pp. 1-32.

Gu et al., "Process optimization and empirical modeling for electrospun polyacrylonitrile (PAN) nanofiber precursor of carbon nanofibers", European Polymer Journal, vol. 41, 2005, pp. 2559-2568.

Niu et al., "Needleless Electrospinnning: Development and Performances", Nanofibres—Production, Properties and Functional Applications, Dr. Tong Lin (Ed.), ISBN: 978-953-307-420-7, pp. 17-36.

Sun et al, "Compound Core-Shell Polymer Nanofibers by Co-Electrospinning", Advanced Materials, 2003, vol. 15, No. 22, pp. 1929-1932.

Kim et al., "Stability analysis for multi-jets electrospinning process modified with a cylindrical electrode", European Polymer Journal, vol. 42, 2006, pp. 2031-2038.

International Search Report and Written Opinion, completed May 26, 2017, pertaining to PCT/IN2017/050037 filed Jan. 25, 2017.

* cited by examiner

X =7.7 cm, a =10 cm, b =26 cm, c=10 cm, d =80 cm, e= 56cm, a b

APPARATUS AND PROCESS FOR UNIFORM DEPOSITION OF POLYMERIC NANOFIBERS ON SUBSTRATE

FIELD OF THE INVENTION

The present invention relates to an apparatus for the mass production of polymeric nanofibres and their uniform deposition over any substrate. The present invention also provides a method for the manufacture of droplet free polymeric nanofibres by electrospinning process using multihole spinnerets. The droplet free polymeric nanofibres of the present invention are preferably of a diameter in the range of 50 nm to 850 nm.

BACKGROUND OF THE INVENTION

Nanofibres are fibres that have diameter equal to or less than 1000 nm. The combination of high specific surface area, flexibility and superior directional strength makes fibre a preferred material form for many applications ranging from clothing to reinforcements for aerospace structures [Doshi, J., and Reneker, D. H., Journal of Electrostatics, Vol. 35, 1995, pp. 151-160].

The use of nanofibres has increased not only in biological/chemical protective clothing, biomedical use and energy storage etc but also in the automobile industry for oil and fuel filters that show high performance, particularly in view of the increasingly strict norms in respect of vehicle emissions. Therefore, the techniques for speedy and large production of nanofiber with improved properties for filtering particulate materials and fine particulate materials in microns are in demand.

Nanofibres can be made by different technique such as Template Synthesis, Phase Separation, Self-Assembly and electrospinning. Electrospinning is the only technique by which fast production nanofibres is possible. Electrospinning can be defined as a process by which a charged liquid polymer solution is introduced into an electric field. A high electric field is generated between a polymer liquid contained in a spinning dope reservoir with a capillary tip or spinneret and a metallic fibre collection ground surface. When the voltage reaches a critical value, the charge overcomes the surface tension of the deformed drop of the suspended polymer solution formed on the tip of the spinneret and a jet is produced. This stretching process is accompanied by the rapid evaporation of the solvent molecules that reduces the diameter of the jet. After the jet flows away from the droplet in a nearly straight line, it bends into a complex path and other changes in shape occur, during which electrical forces stretch and thin it by very large ratios [Reneker, D. H., and Chun, I., Nanotechnology, Volume 7, 1996, pages 216-233; Yarin, A. L., and D. H. Reneker, Journal of Applied Physics. 90 (2001) 4836-4846; Kowalewski, T. A, A. L. Yarin, and S. Blohski, Paper presented at The 5th Euromech Fluid Mechanics Conference, Toulouse, France, Aug. 24-28, 2003].

Fibre morphology in electrospinning is controlled by experimental parameters and is also dependent on solution properties. Various parameters such as conductivity, concentration, viscosity of polymer solution, polymer molecular weight, applied voltage, flow rate, and tip to collector distance, etc. have been shown to have influence over the production of nanofibres. The process can be adjusted to control the fibre diameter by varying some of these parameters [Gu, S. Y., J. Ren and G. J. Vancso, European Polymer Journal, Vol. 41, 2005, pp. 2559-2568].

Many polymers can be used for the development of nanofibres by electrospinning. Some of the examples are PVA, polycaprolactone (PCL), polyamides, polyesters, and polyacrylonitrile, etc.

There are two types of approaches in electrospinning which are used for mass production of nanoweb. These approaches are needle based and needleless electrospinning. Both techniques have some advantages and disadvantages. Problem of nonuniformity and high voltage requirement are there in needleless approach. Also the viscosity of solution changes during the process. [HaitaoNiu, Xungai Wang and Tong Lin (2011). Needleless Electrospinning: Developments and Performances, nanofibres Production, Properties and Functional Applications, Dr. Tong Lin (Ed.), ISBN: 978-953-307-420-7]

Although in needle/nozzle based electrospinning system control over nanofiber quality and area of deposition is better in comparison to needleless system but production rate by single needle is generally very low. So often multiple nozzles arranged in different configuration is used.

Zussman et al. carried out an experimental study and revealed that the jets from multiple nozzles show higher repulsion by another jets from the neighbourhood by Columbic forces than jets spun by a single nozzle process [Zussman E, A. L. Yarin, Wendorff, J H, Greiner, 2003. 15, 1929]. Kim et al. used multiple nozzles electrospinning and shown repulsion between charged jet. They also showed that on using a circular auxiliary electrode around multiple nozzles can help to converse the jets coming towards collector [GeunHyung Kim, Young Sam Cho, Wan doo Kim, European polymer journal, vol. 42, 2006, pp. 2031-2038]. Though the jets could converge, there still existed significant scope of repulsion which can result in nonuniform deposition.

U.S. Pat. No. 7,629,030 B2 discloses multi-nozzle approach for mass production of nanoweb which includes a common source of pressurized liquid. Within a manifold, and an array of 2 or more spraying tips, each tip being fed from the common source of pressurized liquid to create a liquid flow path. But issues associated with multinozzle system like interference of charged jets and uniformity in deposited nanoweb were not addressed.

WO 2004/016839 A1 described an apparatus having multiple nozzles arranged in a row for mass production of nanofiber. A control unit was used with same polarity as spinning nozzles to reduce the dispersion of nanoweb at both end of substrate. The solution was charged by induction method for uniform charging. But this system is not suitable for liquid having low conductivity, moreover the problem of nonuniformity of deposition and dripping was not resolved.

WO 2005/042813 A1 disclosed about rotator spinneret having multiple nozzles in which the generation of arc under high applied voltage between a nozzle and a collection electrode can be minimized; mass production is possible by using improved electrospinning nozzle. The deposition area by each spinneret was ring shape and which would not able to give uniform deposition over the collector width.

In U.S. Pat. No. 6,991,702 B2, multiple nozzle arrangement was shown. The solution was fed by common metering pump and nozzles heads were charged with common transmission rod. Oppositely charged collector was used to collect nanoweb. But uniform deposition of nanoweb was not addressed.

WO 2013/181559 A1 disclosed a new method for mass production of nanofibres using hollow tube having multiple holes arranged in a rowwork. During electrospinning, charged solution coming out from each hole generated nanofibres, which got deposited on grounded collector. This method is only useful for solution having good conductivity, moreover problem of dripping and non uniformity due to charged jet was not addressed.

To resolve the issue of dripping during electrospinning, bottom-up electrospinning apparatus has been reported for fabricating nanofiber from an outlet of a plurality of upward nozzles. This prevented the droplet phenomenon. EP1740743B1, U.S. Pat. No. 7,980,838B2, US2008/0102145A1, WO 2008/36581A1, US2008/0277836A1 used bottom-up electrospinning method. But problem of non-uniformity in deposition was not resolved.

The prior art discloses several methods to make nanofiber non-woven webs at high rates. However, there are drawbacks to each of the methods and there is a requirement to produce cost effective nanofibres, which are defect free and uniformly deposited over a substrate of wide width and length using the most effective and direct method.

It is well known that a nanofiber web using the above nanofiber preparation method can be used as an ultra precise filter, electric-electronic industrial material, medical biomaterial, high-performance composite, etc.

OBJECTIVES OF THE INVENTION

An objective of the present invention is to provide an apparatus and method for uniform deposition of polymeric nanofiber on any substrate i.e. metallic, polymeric, fabrics, filters etc.

An objective of the present invention is to stabilize continuous polymeric nanofibers formation and deposition of the nanofibres uniformly over any substrate surface of large width and length in a continuous manner.

Another objective of the present invention is to provide droplet free polymeric nanofibres using electrospinning process comprising multi-nozzle spinnerets.

Yet another objective of the invention is to design and develop multi-nozzle spinnerets for the generation of polymeric nanofibers for mass production.

Another objective of the present invention is to prepare air, fuel and oil filters comprising filter media having polymeric nanofibers prepared by electrospinning process using multi-nozzle spinnerets.

SUMMARY OF THE INVENTION

The present disclosure provides an apparatus and method for mass production of nanofibrous web via electrospinning. The apparatus and method allow precise control of spread of nanofibers on the substrate by manipulating applied electric field between spinning needles/nozzles and collector. This enables control of electrostatic repulsion of jets emanating from different nozzles/needles to provide uniform deposition of nanofiber web over a large size substrate. This provides a significant advantage in that a uniform deposition of nanofiber web is obtained even at a very low add-on (i.e. mass deposition per unit area) of nanofibers. The designed apparatus also ensures that almost all the nanofibers generated from the needle are attracted towards the collector and get deposited on the substrate. These results in higher yield of nanofibers per unit mass of polymer fed into the system. The apparatus also has a provision for easy cleaning and needle replacement in case of chocking of needles during spinning to avoid long shutdown time and hence better production efficiency.

An aspect of the present disclosure is to provide an electrospinning apparatus for mass production of nanofibers and for uniform deposition of nanofibers on substrate comprising:— a plurality of multinozzle spinneret, each spinneret having two or more rows of nozzles, the each row having two ends and a middle portion, each row having a plurality of nozzles, the nozzle at each of two ends of the rows being idle;

each of the spinnerets being rotatably mounted on a frame, each frame being configured to move in longitudinal direction;

at least one reservoir for storing the polymeric solution, at least one of the spinnerets being in fluid communication with the reservoir for delivering the polymer solution to the nozzles, each of the nozzle being provided with needles in the nozzle outlet opening;

a pressure regulating device to control flow rate of polymer through the nozzles;

a collector or collecting nanofibers on a substrate which is movably disposed on the charged collector;

arrangement for linear movement of substrate in the space between needles outlet ends and the collector;

a dual pole power supply for charging the needles and the collector, the needles outlet ends and the collector having opposite polarity;

characterized in that the plurality of spinnerete are mounted in the frame with a mechanism comprising parts made of any non conducting material, to adjust interspace between two adjacent spinnerets and to adjust angle of the rows of nozzles on the spinneret with respect to direction of movement of the substrate for uniform deposition of nanofibers.

An embodiment of the present disclosure provides an apparatus wherein the rows of nozzles on the spinneret are arranged at an angle of 5° to 45° to the direction of movement of the substrate.

An embodiment of the present disclosure provides an apparatus wherein elliptical nanowebs get deposited on moving substrate, which overlap with each other to form uniform film.

An embodiment of the present disclosure provides an apparatus wherein the substrate is arranged to move in longitudinal direction, the substrate being fed from feed roll and being wound over a winder roll.

Another embodiment of the present disclosure provides an apparatus wherein a connector element is provided with grooves and a spring loaded screw system to keep the needles spaced apart and to removably mount the plurality of needles and to facilitate removal of needles for easy cleaning and replacement of clogged and damaged needles from the spinnerets.

Another embodiment of the present disclosure provides an apparatus wherein the connector element is provided for electrically connecting each of the plurality of needles to power supply.

Another embodiment of the present disclosure provides an apparatus wherein nanofibers are made of a polymeric material or combination of polymeric materials.

Yet another embodiment of the present disclosure provides an apparatus wherein the collector is designed to be either moving or stationary, the collector being connected to a polarity opposite to that of needles.

Yet another embodiment of the present disclosure provides an apparatus wherein nanofibers have diameter in the range of 50 nm to 850 nm.

Yet another embodiment of the present disclosure provides an apparatus wherein the substrate is passed over a conventional/infrared (IR) heater for complete drying and/or curing of nanoweb deposited on the substrate.

Still another embodiment of the present disclosure provides an apparatus wherein the substrate comprises filter media having polymeric nanofibers, which are prepared by electrospinning process using multi-hole spinnerets.

Still another embodiment of the present disclosure provides an apparatus wherein substrate is made of natural or synthetic polymer, such as cellulose, polyamides, polyester, polyacrylonitrile, polypropylene, polyethylene, etc or a ceramic or a metal, for use in range of applications such as filtration, biomedical scaffold and devices, protective garments, etc.

Still another embodiment of the present disclosure provides an apparatus wherein polymeric solution is exposed to electric field of strength 10 kV to 100 kV.

Still another embodiment of the present disclosure provides an apparatus wherein and the collector is made of a conducting material selected from the group consisting of metals and conducting composites.

Still another embodiment of the present disclosure provides an apparatus wherein the spinnerets have interspacing between nozzles from 10 mm to 100 mm.

Still another embodiment of the present disclosure provides an apparatus wherein the spinnerets have interspacing between rows of nozzles from 15 mm to 200 mm.

Still another embodiment of the present disclosure provides an apparatus wherein nozzles is made of a conductive or a non conductive material.

Another aspect of the present disclosure is to provide a method for mass production of nanofibers and for uniform deposition of nanofibers on substrate comprising the steps of:

- preparing a solution of polymer in aqueous or organic solvents;
- storing the solution in at least one reservoir over plurality of spinneret with multinozzles provided with needles for delivering the polymeric solution;
- applying an electric field to the needle at a tip connected with each nozzle by using connector device such that the charge overcomes the surface tension of a deformed drop of polymer solution to form nanofibers; and
- collecting the nanofibrous web from charged needle tip onto a substrate moving longitudinally over oppositely charged collector.

These and other features, aspects and advantages of the present subject matter will become better understood with reference to the following description and appended claims. This summary is provided to introduce a selection of concepts in a simplified form. This summary is not intended to be used to limit the scope of the claimed subject matter.

DETAILED DESCRIPTION WITH REFERENCE TO ACCOMPANYING DRAWINGS

It should be noted that the invention can be embodied in various alternative apparatuses. An examplary embodiment of the present invention that describes the invention herein with reference to figures is as follows.

Figure 1:
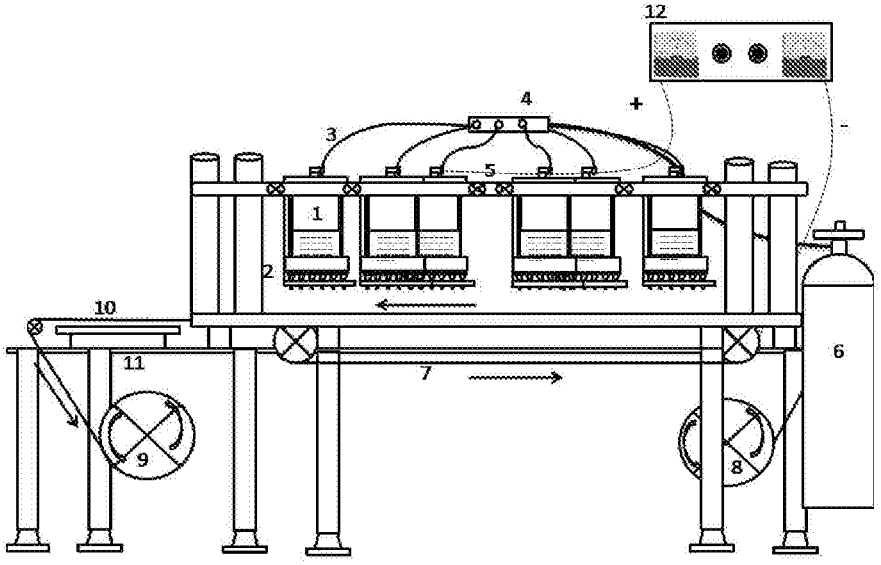
FIG. 1 is a schematic representation of electrospinning setup showing spinneret of the invention ready for use.

Referring to FIG. 1, which shows a schematic representation of the spinneret of the invention ready for use, showing the presence of multiple needles connected to the respective nozzles and connected with wire coming from power source through the connectors. In the machine there are multinozzle or multineedle spinnerets (1), power connector for charging polymer solution attached to the needles (2), pressure pipe (3) to control the flow rate, manifold (4) for uniform pressure application from gas cylinder with pressure regulating device (6) with compressed air/gas. All the spinnerete are held by a frame (5) having mechanism to adjust interspace between any two spinnerets and angle of row of multinozzles/multineedles with respect to moving substrate for uniform deposition. Oppositely charged collector (7) is covered with substrate (10) fed from feed roll (8) and is wound over winder roll (9). Before winding, the substrate is passed over conventional/infrared (IR) heater for complete drying and/or curing of nanoweb deposited on the substrate. The dual pole power supply system (12) is used for charging nozzles/needles and collector as required.

The apparatus shown in FIG. 1 adopts a pumping arrangement which causes the solution to forcibly flow into the storage tank during feed operation. The polymer solution can be mixed with additives including any resin compatible with an associated polymer, plasticizer, ultraviolet ray stabilizer, crosslink agent, curing agent, reaction initiator and etc. Although dissolving most of the polymers may not require any specific temperature ranges, heating may be needed for assisting the dissolution reaction.

The apparatus of the invention comprises a storage tank to hold a polymer solution. The polymer solution may be fed into the tank in a pre-mixed form in controlled rate by using any flow controlled device, or alternatively, the polymeric solution can be filled in individual container followed by application of suitable pressure to control the flow rate of solution through nozzles. The tank is provided with a detachable top cover. The top cover is provided with a pressure regulating mechanism such as a pressure valve. The detachable top has also an orifice to continuously supply melt or solution of the polymer therein. The pressure regulating means ensures constant rate of flow for polymer solution through nozzles depending on the nature of the polymer. This ensures that due to the pressure, the solution is extruded out from the nozzles and through the needles into the spinning zone and gets deposited on to a collecting plate. For continuous electro spinning for long run, constant positive pressure should be maintained. A high electrical voltage is applied at the needle end of the tank to ensure that the solution of polymer exiting the tank is charged with either positive or negative charges.

The bottom end of the tank is provided with a detachable base. The base is provided with a plurality of nozzles. The nozzles are preferably arranged in two or more of substantially parallel rows. The interspace between nozzles arranged in a row as well as between row of nozzles in every cylinder is kept at a minimum of 10 mm and 15 mm, respectively to avoid frequent dripping due to interference of similar charges present on the needles. Each intermediate nozzle in a row is spaced apart at an equal distance (preferably about 10 mm to 100 mm) from its immediately adjacent neighbour. Each nozzle in different row is spaced apart from its neighbour parallel row at a distance in the range of 15 mm to 150 mm Each nozzle preferably has a bore diameter in the range of 1 mm to 5 mm and the nanofibers are collected on a web of conventional filter media over said collector plate. The nozzles can be made of any conductive or non-conductive material and needle is connected with every nozzle, have inner diameter from 0.1 to 2 mm with flat surface. The arrangement of spinneret depends on polymer type and changes with respect to interspacing and area of elliptical deposited nanoweb. The angle of the rows of nozzles on the spinneret with respect to direction of movement of the substrate vary from 10 to 45 degree according to electrospinning conditions (i.e. polymer solution needle to collector distance, No of spinneret or nozzles and their interspacing flow rate, voltage etc. and environment conditions). The reservoir for storing polymeric solution can be made of any non-conductive polymeric material which is not reacting with solution stored. The collector may vary from 20 mm to any width and should be isolated for machine frame by non-conducting material to avoid any discharge. The polymeric solution is exposed to electric field of strength 10 kV to 100 kV.

The arrangement of the nozzles is such that the end nozzles in each row are idle nozzles charged by the same polarity as the other spinning needles. Idle nozzles are the nozzles, through which polymer solution does not flow, however, idle nozzles are charged so that all spinning needles experience same electric field. Each needle should be of same length with the lower circular end cut horizontally.

Figure 2:
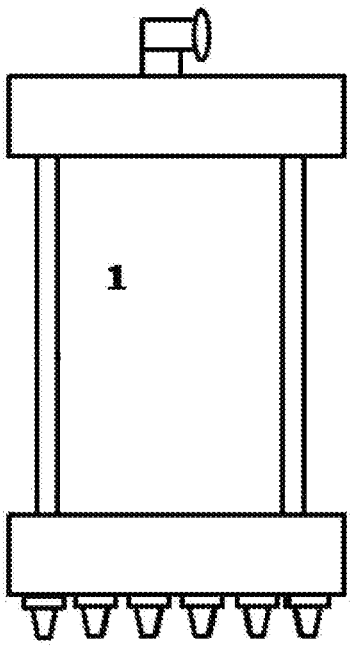
FIG. 2 is a schematic representation of cylindrical tank with spinneret head having multinozzle and lid for gas input.

FIG. 2 is a schematic representation of the tank housing. The housing is essentially a rectangular or cylindrical body preferably made of polymeric or coated glass material. The tank can be made of any polymeric insulted material and should be inert to the polymer solution. The inner diameter of the tank is preferably around 5-30 cm and the wall thickness of 1-15 mm Nozzles/needles are arranged in one or more than one rows with inter space between two adjacent nozzles in a row is 1 to 10 cm and inter space between two rows can vary from 1 to 10 cm to minimize interference from adjacent nozzles/needles. The upper part of cylindrical/rectangular container has a lid with a pressure control mechanism. A predetermined pressure is applied to control the flow rate of the polymer from the nozzles/needles during the spinning process. The pressure control mechanism can involve any of the methods known to an expert in the area of fluid flow and may include pressure regulating valve provided with an external meter which enables monitoring of the pressure inside the tank housing. This enables a smooth and continuous flow of polymer solution from the tank housing to the needle through the nozzle. Alternatively metering pump with manifold for continuous supply of polymeric solution can also used to control flow rate of solution from individual nozzle.

Figures 3A, 3B, 3C, 3D:
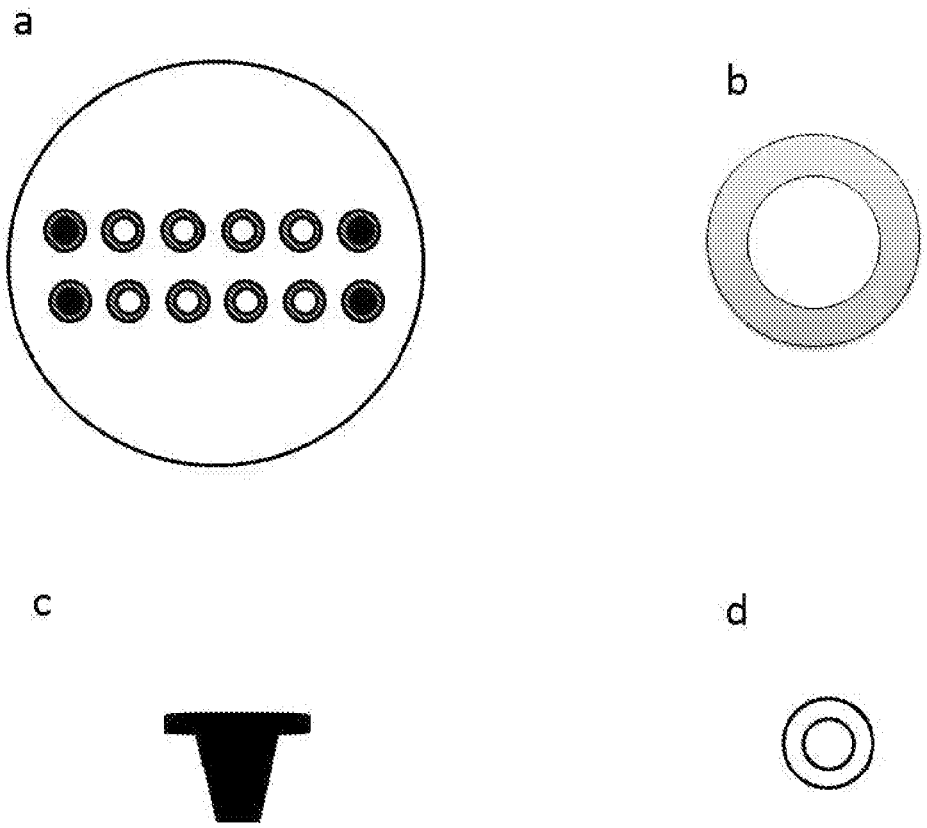
FIG. 3*a* is a schematic representation of the spinneret head (detachable base for the spinneret) with multiple nozzle arrangement (two parallel rows of nozzles) and idle nozzles at ends.
FIG. 3*b* is a schematic representation of the cylindrical vessel connected with spinneret head at bottom and cap at upper side.
FIG. 3*c* is a schematic representation of the nozzle.
FIG. 3*d* is a schematic representation of the upper and lower inner diameter of working nozzle.

FIG. 3 is a schematic representation of the detachable base for the spinneret shown as a preferred embodiment, with the presence of two or more parallel rows of nozzles, to which needles may be attached. The embodiment covered in FIG. 3 comprises two parallel rows of equidistant spaced nozzles, each row containing six nozzles. An idle nozzle is provided on each end of each row of the nozzles, which are not connected to the inside of the tank. The polymer solution flows into the nozzles and then through the needles attached to the nozzles, except for the idle nozzles/needles provided at each end of the each row. The length of the nozzle projection, to which a needle may be attached, is preferable in the range of 2 mm to 20 mm.

Figure 4:
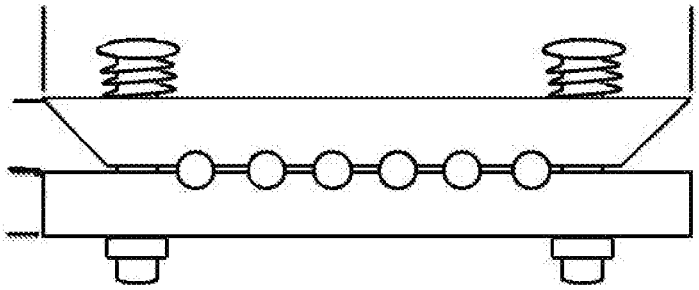
FIG. 4 is a schematic representation of the connector element.

FIG. 4 is a schematic representation of the connector element. The connector element is preferably made of good conductor such as copper or gold coated copper, and is provided with grooves and a spring loaded screw system to keep the needles spaced apart and at the same time properly connected with the power supply. This allows equal distribution of charge to all the needles by ensuring sufficient pressure on each needle and ensure better contact and easy to remove and install again and facilitates easy cleaning and replacement of clogged or damaged needles from the spinnerets.

Figure 5:
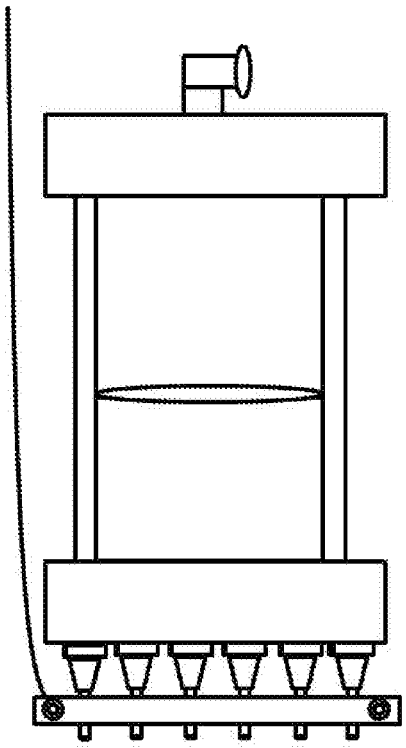
FIG. 5 is a schematic representation of spinneret with the connector element ready to use.

FIG. 5 is a schematic representation of the spinneret assembly of the invention ready for use, showing the presence of multiple needles connected to the respective nozzles and held apart through the connector elements, and connected to the base of the spinneret tank. The spinneret essentially comprises a storage tank with an opening at the top end thereof to receive melt/solution of the polymer and an opening at the bottom end thereof to attach a base unit provided with multiple nozzles and respective needles. The needles and the nozzles are held together at fixed distance to each other using a connector element provided with a spring loaded screw system (as described above). The connector element is connected to one pole of the power supply. The top opening is provided with a lid/cover having an inlet nozzle and a pressure valve.

Figure 6:
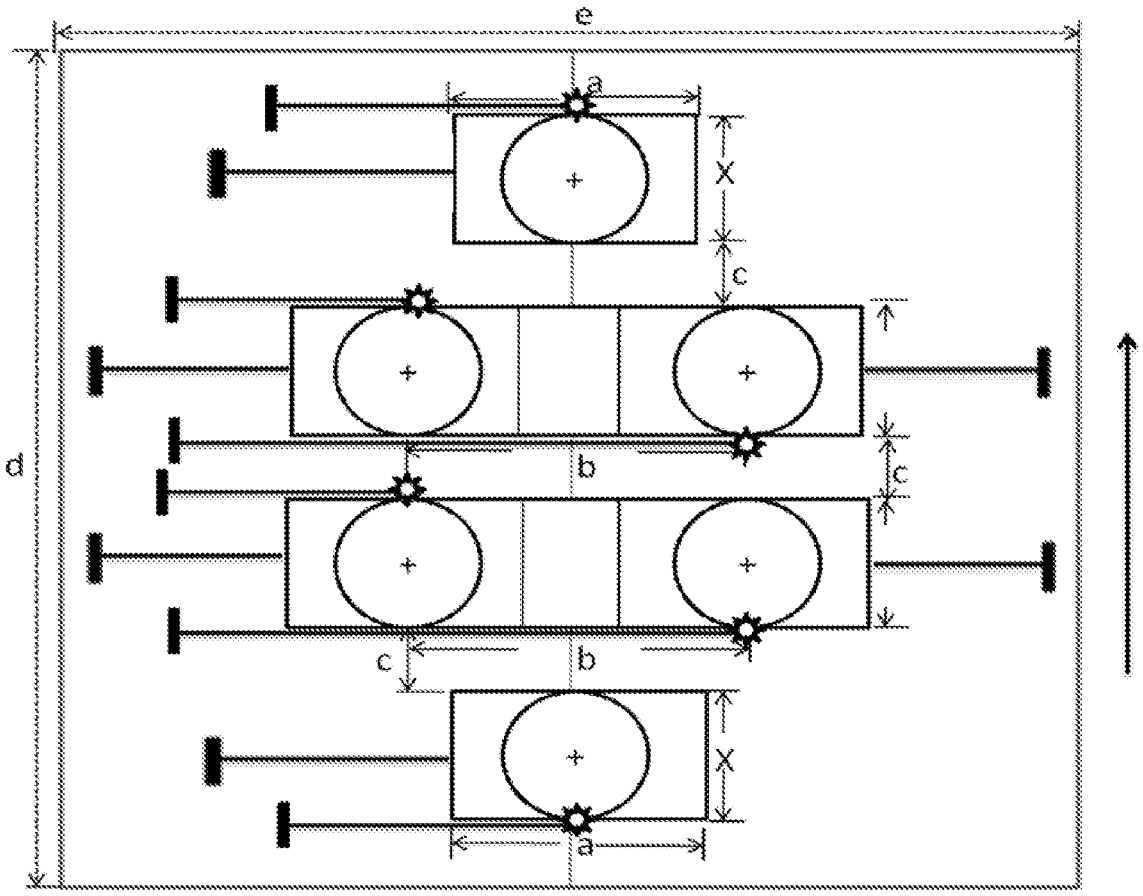
FIG. 6 is a schematic representation of the spinneret holding frame for holding six spinnerets.

FIG. 6 shows spinneret-holding frame having provision to hold many spinnerets (circle shown in figure) and provision for rotating the spinneret assembly for attaining required angle in the range of 5° to 45° of nozzles arrangement in row with respect to moving substrate. The rectangular block is connected with rod at centre to adjust the interspacing of adjacent spinneret. The frame can be made of any nonconductive material such as a polymer and/or ceramic. Various requisite dimensions are shown only as an example.

Figure 7A:
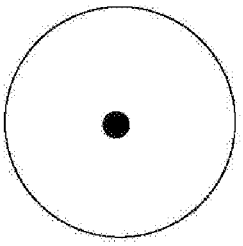
FIG. 7*a* shows bigger circle which is nanoweb deposited by single needle and black circles are needles.
Figure 7B:
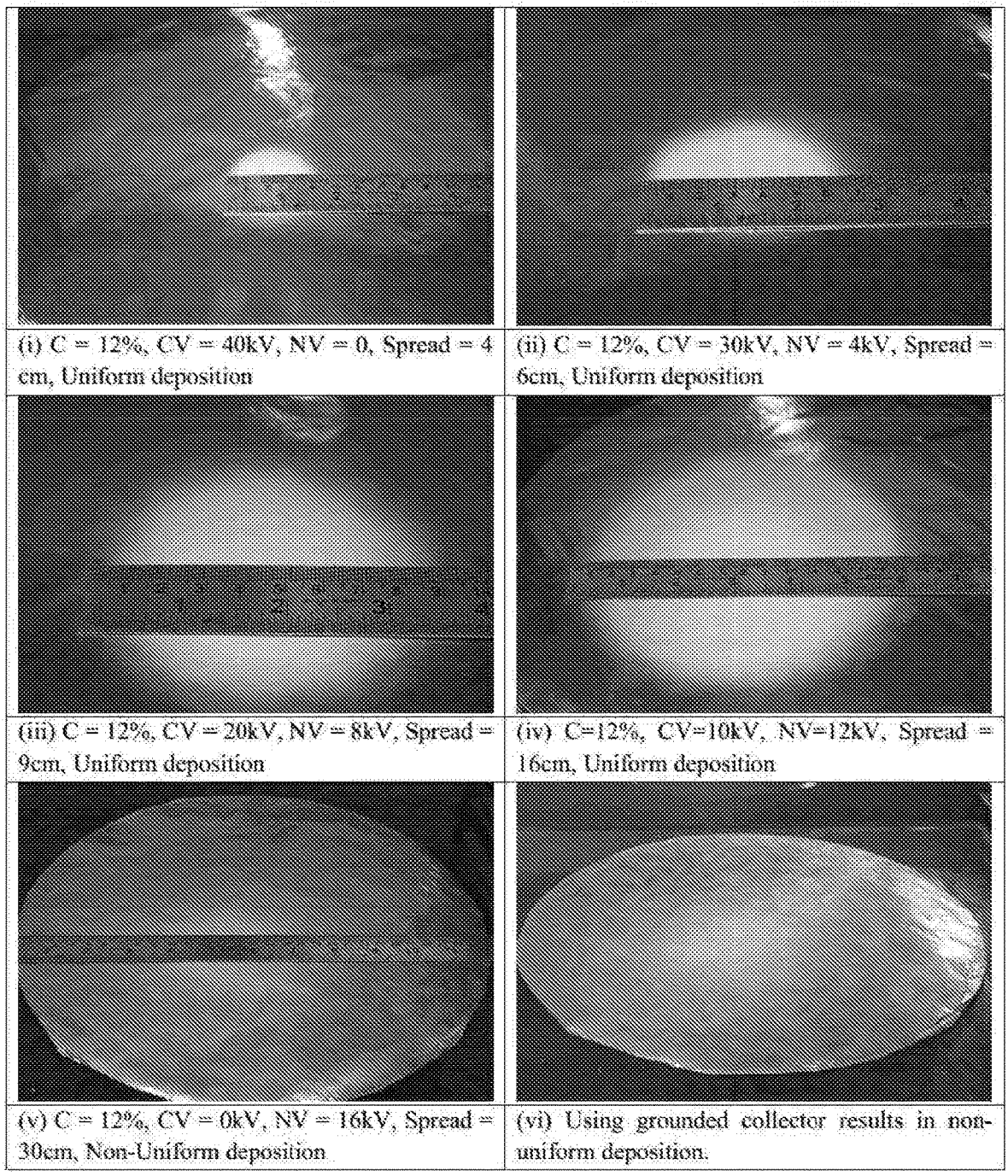
FIG. 7*b* shows effect of collector voltage on area of nanoweb deposition
Figure 8A:
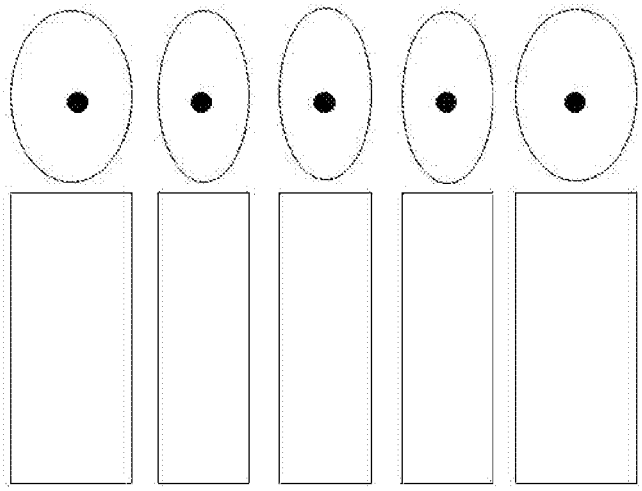
FIG. 8*a* shows deposition pattern obtained by needles arranged in linear fashion
Figure 8B:
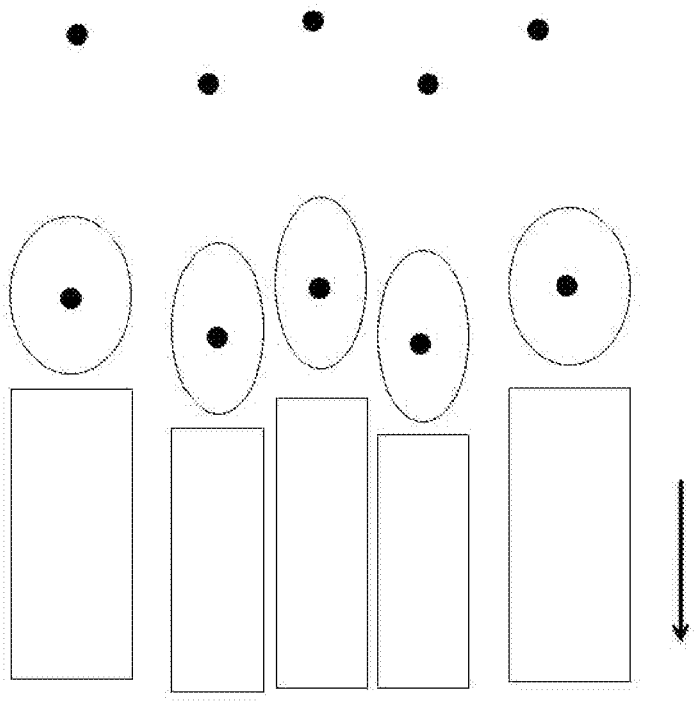
FIG. 8*b* shows deposition pattern obtained by needles arranged in a zigzag fashion
Figure 8C:
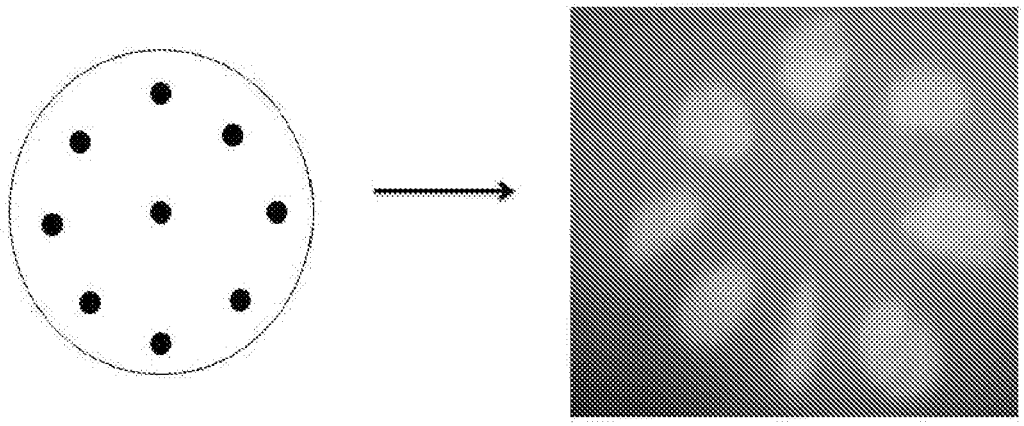
FIG. 8*c* shows deposition pattern obtained by needles arranged in a circular fashion.

FIG. 7*a* shows the nanoweb deposited by single needle. The area of deposition achieved by one working needle can be changed by application of collector voltage keeping the overall electrospinning voltage same as shown in FIG. 7*b*. To increase the production of nanofibres number of electrospinning needles were arranged in different pattern i.e. linear, zigzag and circular. FIGS. 8*a*, 8*b* and 8*c* show the pattern of deposition for stationary collector and moving collector/substrate. If the substrate is kept stationary and spinning is carried out using five needles arranged in a linear fashion, then the nanoweb deposition similar to the arrangement of needles is obtained. However, if the nanowebs are elliptical in shape with long axis perpendicular to the needle arrangement direction the collected web appears as shown in FIG. 8*a*. When the nanowebs were obtained using a linear arrangement of needles, without the presence of idle needles, the shape of the nanowebs deposited by the inside needles and the outward needles differs. It is attributed to the fact that the three middle needles experience equivalent electric field and hence inter-jet repulsion from the two both sides, however, the needles at each end experience electric field from only from one side. If the substrate is moved in the direction shown, which is perpendicular to the direction of needles arranged in a row, then nanowebs are deposited as separate strips as shown in FIG. 8*a*.

If the needles are kept in zigzag arrangement as shown above, then also the nanowebs similar to those obtained in the linear arrangement (FIG. 8*a*) are obtained. The only difference is that the space between the webs gets reduced and the centre strips are thinner. However, the space cannot be removed because the two adjacent jet experience repulsion equally from both sides. This effect is shown in FIG. 8*b*.

Similarly, the area of deposition obtained by 9 needles arranged in circular fashion is shown in FIG. 8*c*. The needle present at the centre is not able to electrospin at all due to strong repulsive forces created by the surrounding needles.

Figure 9A:
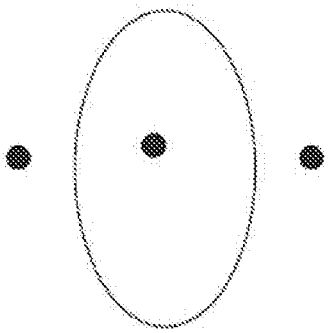
FIG. 9*a* shows elliptically deposited nanowebs after placing two charged idle needles on each side of the electrospinning needle.
Figure 9B:
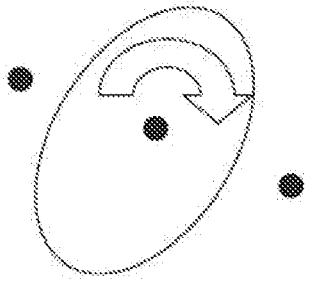
FIG. 9*b* shows rotation of the elliptically deposited nanoweb on displacing the needles at an angle. Black circles are needles; only one web is shown for simplicity.

To obtain uniform deposition of the nanoweb, the needles should be so arranged so that any particular needle experiences equal repulsive force from diagonally opposite sides (in one direction). Further, the needles are arranged at an angle of 5° to 45° to the direction of movement of the substrate. This moves the ellipse from straight ellipse to an ellipse at an angle as shown below in FIG. 9. The angle is decided by the elliptical pattern obtained by a particular spinning system (i.e. polymer type, spinning parameters i.e. polymer solution rheology, spinneret to collector distance, flow rate, type of substrate etc. and spacing between the needles).

This is also equivalent to moving the substrate at an angle to a linear arrangement of needles discussed above.

Therefore, if the needles in a row are arranged at an angle to the direction of the movement of the substrate, elliptical nanowebs get deposited, which on moving the substrate, overlap with each other to form uniform film. This is shown in FIGS. 10*a* and 10*b*.

Figure 10A:
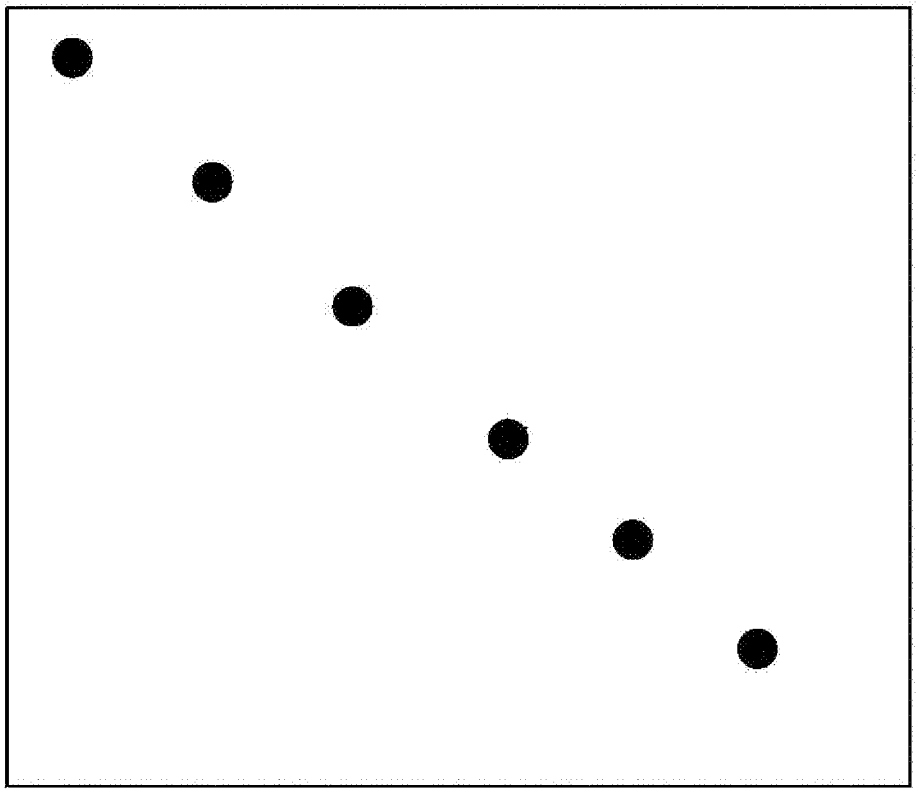
FIG. 10*a* shows arrangement of needles in a row placed diagonal to the moving substrate.

FIG. 10*a* shows the arrangement of needle placed in diagonal manner in a plane against the direction of moving substrate. Needles are shown as black filled circles.

Figure 10B:
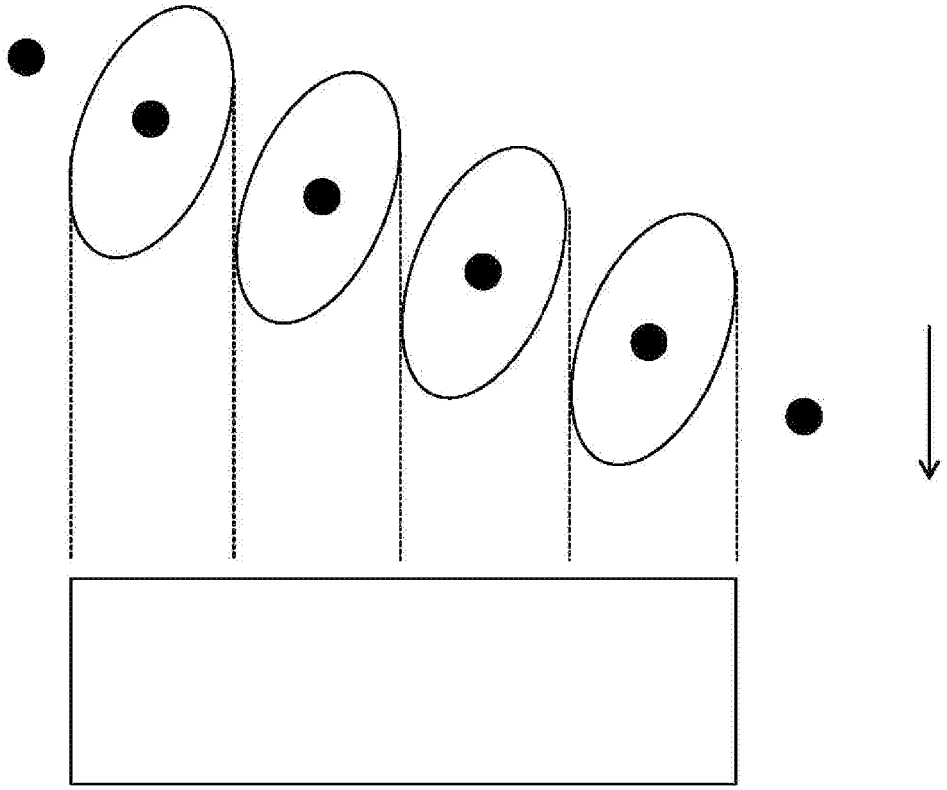
FIG. 10*b* shows pattern of nanofibre deposition obtained after placing the needles of a row at an angle with respect to direction of moving substrate.

In the FIG. 10*b* deposition by individual working needles at centre are shown as ellipse. The black circle shows needle position placed over deposition area. When substrate moves in the direction of arrow shown, the uniform deposition of nanofiber obtained which is shown by rectangular block.

Figure 11:
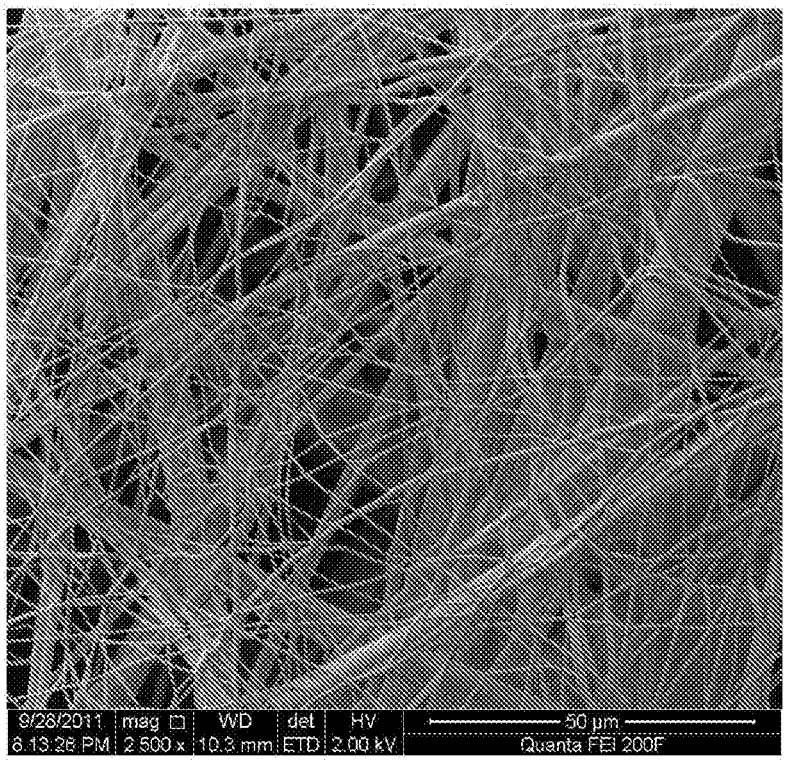
FIG. 11 shows PVA (Polyvinyl alcohol) nanoweb over filter paper.

FIG. 11 shows nanofiber deposited by PVA nanofiber over filter paper.

Concept of Uniform Deposition:

Various types of multi needle arrangements were assessed, which have been discussed later. It was found that the needles located with similar repulsive force from all sides do not spin properly; however, if the needles experience equal repulsive force only from two sides, it spins properly with an oval shape deposition of nanoweb. All needles having similar electric field pattern spin same shape giving uniform patterns. The needles inside a row spin uniform patterns as they experience same type of electric field from the two sides, however, the needles at the end of the row show different pattern resulting in non-uniform deposition towards the end. Therefore, two idle needles were introduced at the two ends of each row so that all spinning needles experience same electric field pattern. This allowed similar spinning behaviour from all spinning needles. The size of tank depends on interspacing of nozzles, ease of rotation, ease of cleaning and replacement of needles to reduce down time and for continuous production for long time. The shape of tank and the spinneret can be of different shape like rectangular, circular or oval or any other because shape does not affect electrospinning behaviour. In one preferred embodiment, the tank has an inner diameter of 85 mm, which was found to be appropriate for holding 2 parallel rows of 6 spinning and 2 idle nozzles each.

In order to obtain uniform deposition of the nanoweb, the needles should be so arranged so that any particular spinning needle experiences equal repulsive force from two diagonally opposite sides. The remaining two sides should have much weaker repulsive forces. This gives elliptical (or oval) pattern of deposition of nanoweb on the substrate. Further, the needles-rows are arranged at an angle of 5° to 45° to the direction of the movement of the substrate. This tilts the elliptical area of nanoweb deposited by individual spinning needle from straight to an angle. The angle is decided by the elliptical pattern obtained by a particular spinning system (i.e. rheology of polymer solution/melt, spinning parameters, such as needle to substrate distance, needle voltage, the collector voltage, flow rate of the polymer solution/melt, and spacing between the needles). This is also equivalent to moving the substrate at an angle to a linear arrangement of needles.

Each nozzle is provided with a removable needle having preferably a circular cross-sectional shape with diameter of about 0.1 mm to 5 mm Each row of needles is kept in position through a connecter-element, which is affixed to the base. The purpose of the connector element is to ensure that the needles are kept charged equally and also kept equidistant from each other during operation. An additional advantage provided by the connector is towards the ease of replacement and cleaning of the needles from the spinneret assembly. During operation, there is a possibility that the needles may get clogged with the melt or solution of the polymer. In prior art systems, clogged or choked needles required shutting down of system and replacement of the entire spinneret assembly. The present system enables individual needles to be cleaned/replaced. The needles are operatively connected to the connector-element through grooves provided with a spring loaded screw system. The connector-element also ensures that the charging level for all needles is substantially uniform.

The polymer solution discharged from the spinning nozzles/needles is collected in the form of a web on a substrate placed/moved over a collector placed under the spinning nozzles. The collector is grounded or charged with opposite polarity to that of the needles. There is also a provision to draw out atmosphere composed of air or gas maintained between the nozzles/needles and the collector, slowly by flowing the atmospheric gases in from one side and out at the other end through the spinning and high voltage region between the spinning nozzles and the collector. Air drawn out of the spinning zone/region contains solvent. A solvent recovery mechanism can be provided which is designed to recover solvent while recycling air through the same. The solvent recovery system can be of conventional design known in the literature.

During the initial stage of electrospinning process, experiments were conducted on lab scale by using spinnerets with different setups. The performance of the media was assessed in terms of efficiency. While conducting the experiments using different polymer solution, the needles got choked and it caused visual droplet formation (electro spraying) and micro droplet formation on the surface of media. The application of pressure and use of proper needle bore size and arrangement of needles in the spinneret as discussed above, resulted in long spinning hours of the spinneret without chocking of needles, dripping of polymer from the needles, or droplet formation. The generation of defect free, bead free and droplet free nanofibres using different polymer solutions/melts is one of the most significant characteristics in automotive filters, and it affects the performance in terms of pressure drop, efficiency and contaminant holding capacity.

In the present invention, the nanofibres generated are sandwiched between a pre-filtering melt blown media with high dust-holding capacity and a fine supporting cellulose filter media. This approach has significantly improved particle retention efficiency and water separation efficiency with enhanced dust holding capacity in fuel applications in comparison to standard filter media. The filter media for air or oil filter applications comprises two layers wherein the first layer comprising phenol formaldehyde resin impregnated cellulose media and the second layer comprising polymeric nanofibres. The second layer comprises polymeric nanofibres coated on cellulose media in the range of 0.1 GSM to 0.5 GSM.

Suitable polymers that could be spun using the above system include polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutyleneterephthalate), SBR (styrene butadiene rubber), polystyrene, PVC (polyvinyl chloride), polyvinyl alcohol, PVDF (polyvinylidene fluoride), polyvinyl butylene and copolymers or derivative compounds thereof. The choice of solvent is function of the polymer of choice. The solvent may be water, N—N-di-methylfonnamide, Di-methyl solfoxide etc. organic and water whichever required to make homogeneous solution.

EXAMPLES

The following examples are given by way of illustration of the present disclosure and should not be construed to limit the scope of present disclosure. It is to be understood that both the foregoing general description and the following detailed description are exemplary and explanatory only and are intended to provide further explanation of the subject matter.

Example 1

The configuration in this invention was used for producing uniform nanowebs of polyvinyl alcohol using 11.5 wt % aqueous solution of PVA polymer. The apparatus was used for electrospinning of PVA on a 40 cm wide substrate. Pressure applied to control flow rate was 10 cm water column. Electrospinning was done using 18G needle at 14 cm needle to collector distance. During experiment temperature was maintained 25° C. and RH at 52-53%. The modular spinning system comprised of 6 spinnerets with 8 spinning and 4 idle needles in each spinneret. The space between spinnerets could be changed depending on the polymer system. The diagonal configuration could be changed to any angle from 10-40 degree from direction of substrate movement to allow different levels of overlapping between the adjacent elliptical nanowebs. This would depend upon the size and uniformity of the elliptical web being produced by a particular spinning system. The voltage used for electrospinning were +39 kV and −25 kV respectively. In this particular experiment uniform deposition could be obtained at 3m/min. To increase speed one can use more no of electrospinning module arranged in line across the width of substrate. The spinnerets has interspacing between nozzles from 10 mm to 100 mm and interspacing between rows from 15 mm to 200 mm as below 15 mm usually there are chances of dripping. In order to control the nanoweb deposition, collector voltage plays important role. The area of deposition for electrospun nanoweb also depends on polymer type and height; hence collector voltage is one of the important tools to control the area of deposition for nanoweb.

The spring loaded connector provides easy charging for needles as well as facilitate in replacement of needles if requires. Both needle and collector should be charged for uniform deposition. Both stationary and moving collector must be kept isolated from other conducting part of machine to avoid any current leakage or discharging during electrospinning. This is also important for safety of person handling or around machine. To control the position as well as angle of needles in individual spinneret, a spinneret holding frame was as described above was used. SEM image for the PVA nanoweb deposited over filter paper is shown in FIG. 11. These SEM image was taken using Environmental Scanning Electron Microscope model FEI Quanta 200F at 10.3 mm working distance 2 KV electron gun voltage. FIG. 11 showing good quality of nanofibers deposited over filter substrate with 2500 magnification value.

Example 2

Electrospuning of 14% Cellulose Acetate solution in Acetone:DMF:DMSO::3:1:1 (w/w).

Figure 12:
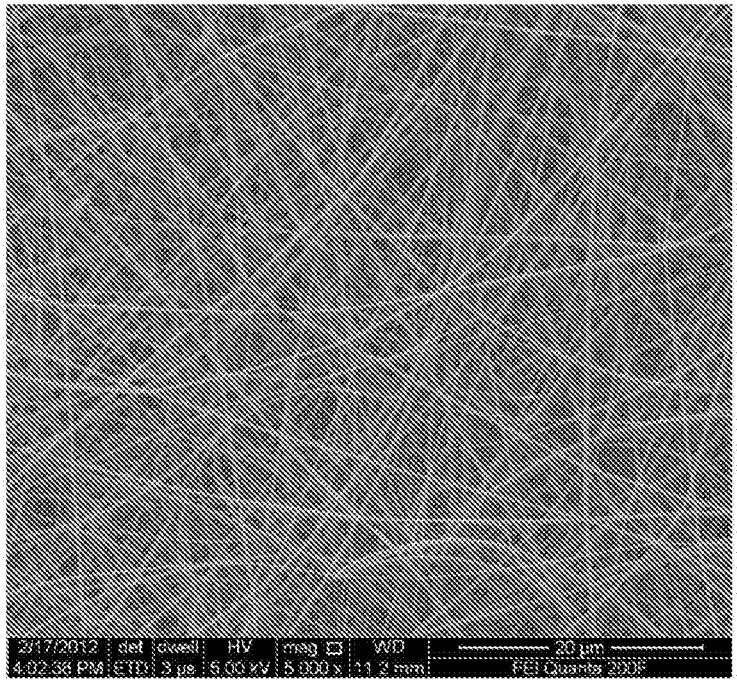
FIG. 12 shows 14% Cellulose Acetate (CA) nanoweb electrospun from mass production unit.

14% CA solution was prepare by dissolving Cellulose Acetate (Mw=50,000) mixture of Acetone:DMF:DMSO in 3:1:1 (w/w). The electrospinning was done at 25° C. temperature and 40% RH. 18 Gauge needle with 15 cm needle to collector distance and 15 cm water column pressure were used during experiment. SEM images for 14% CA nanoweb are given in FIG. 12.

Example 3

Figure 13:
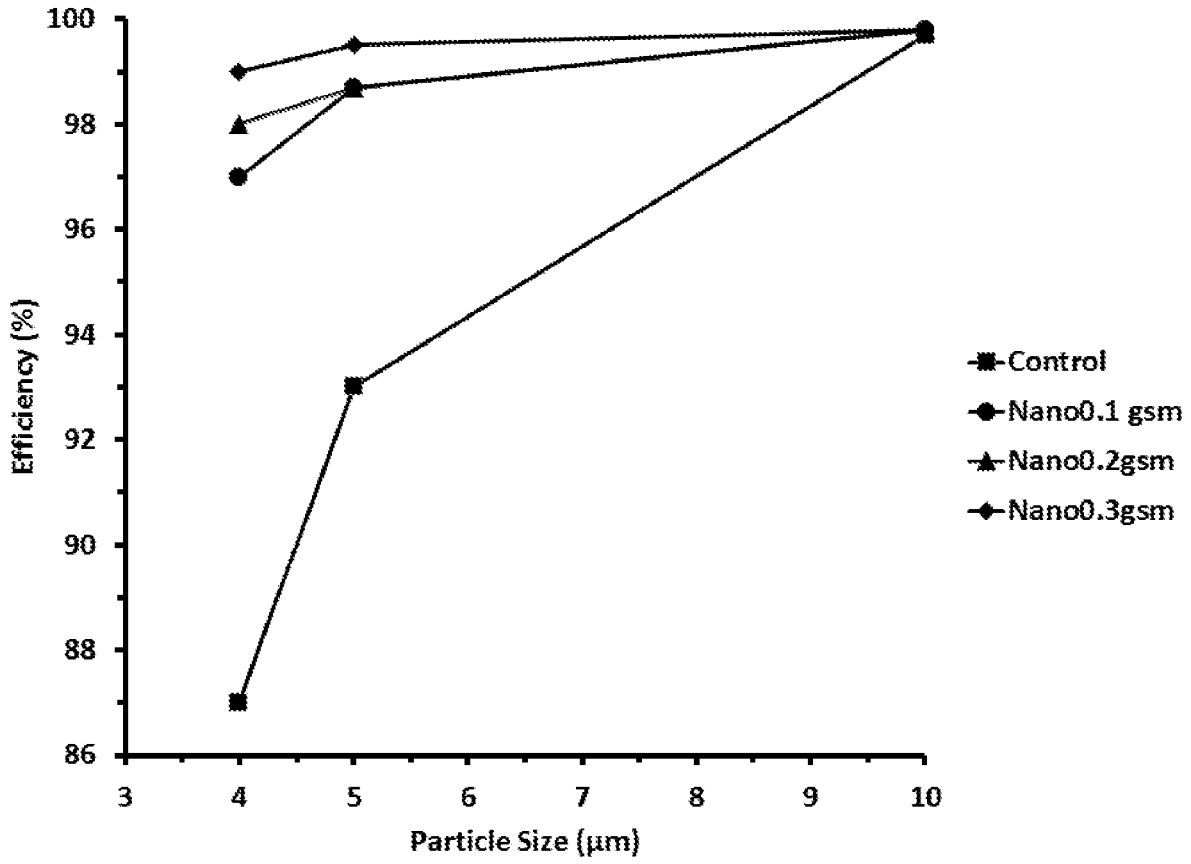
FIG. 13 shows particulate size vs efficiency graph for nanoweb and control filter paper.

Initial filtration efficiency of 0, 0.1, 0.2 and 0.3 GSM nanofiber deposited on filter in fuel for 4, 5 and 10 μm particulates is shown in figure. ISO medium test dust was used at 100 mg/l as per ISO 19438 standard. Deposition of nanoweb over filter paper increases initial filtration efficiency from 87% to 96%. The results are shown in FIG. 13.

Image was taken using Environmental Scanning Electron Microscope model FEI Quanta 200F at 11.2 mm working distance 5 KV electron gun voltage with 5000 magnification value.

ADVANTAGES

1) The nanofibers are uniformly deposited on the substrate.

2) The clogged and damaged needles can be replaced from spinnerets.

3) The nanofibers which are generated are droplet free and bead free.

4) The nanofibers have diameter in the range of 50 nm to 850 nm.

We claim:

1. An electrospinning apparatus for mass production of nanofibers and for uniform deposition of nanofibers on substrate comprising:

a plurality of multinozzle spinnerets, each spinneret having two or more rows of nozzles, each row having two ends and a middle portion, each row having a plurality of the nozzles;

each of the spinnerets being mounted on a frame, each spinneret being configured to be moved in a longitudinal direction;

at least one reservoir for storing a polymeric solution, at least one of the spinnerets being in fluid communication with the reservoir for delivering the polymer solution to the nozzles, each of the nozzles being provided with a needle in a nozzle outlet opening;

a pressure regulating device to control flow rate of polymer through the nozzles;

a charged collector for collecting nanofibers on a substrate which is movably disposed on the charged collector;

an arrangement for linear movement of the substrate in the space between needles outlet ends and the collector;

a dual pole power supply for charging the needles and the collector, the needles outlet ends and the collector having opposite polarity;

characterized in that the needle at each of the two ends of the rows is electrically charged but no polymer solution is delivered to said nozzle at each of the two ends, the rows are arranged at an angle to a direction of movement of the substrate such that each needle from two diagonally opposite sides in a row of the needles experiences equal repulsive forces and remaining two opposite sides of the respective needle have weaker repulsive forces, a distance between adjacent nozzles in a row of the nozzles being kept lesser than the distance between two adjacent rows of the nozzles, the plurality of multinozzle spinneretes are mounted on the frame with a mechanism comprising parts made of a non conducting material, to adjust interspace between two adjacent spinnerets, and in that a mechanism is provided to adjust an angle of each row of the nozzles on the spinneret with respect to the direction of movement of the substrate for uniform deposition of nanofibers on the substrate.

2. The apparatus as claimed in claim 1, wherein the rows of nozzles on the spinneret are arranged at an angle from 5° to 45° to the direction of movement of the substrate.

3. The apparatus as claimed in claim 1, wherein nanofibers in form of elliptical nanowebs get deposited on the moving substrate, which overlap with each other to form uniform film.

4. The apparatus as claimed in claim 1, wherein the substrate is arranged to move in a longitudinal direction, the substrate being fed from a feed roll and being wound over a winder roll after deposition of nanofibers on the substrate.

5. The apparatus as claimed in claim 1, wherein a connector element is provided with grooves and a spring loaded screw system to keep the needles spaced apart and to removably mount the plurality of needles and to facilitate removal of the needles for easy cleaning and replacement of clogged and damaged needles from the spinnerets.

6. The apparatus as claimed in claim 5, wherein the connector element is provided for electrically connecting each of the plurality of needles to the power supply.

7. The apparatus as claimed in claim 1, wherein nanofibers are made of a polymeric material or combination of polymeric materials.

8. The apparatus as claimed in claim 1, wherein the collector is designed to be either moving or stationary, the collector being connected to a polarity opposite to that of the needles.

9. The apparatus as claimed in claim 1, wherein the nanofibers have a diameter in the range of 50 nm to 850 nm.

10. The apparatus as claimed in claim 1, wherein the substrate after deposition of the nanofibers in form of a nanoweb is passed over an infrared (IR) heater for complete drying and/or curing of the nanoweb deposited on the substrate.

11. The apparatus as claimed in claim 1, wherein the substrate comprises filter media having polymeric nanofibers, which are prepared by electrospinning process using multi-hole spinnerets.

12. The apparatus as claimed in claim 1, wherein the substrate is made of natural or synthetic polymer, a ceramic or a metal.

13. The apparatus as claimed in claim 1, wherein the polymeric solution in the nozzles is exposed to an electric field of strength from 10 kV to 100 kV.

14. The apparatus as claimed in claim 1, wherein and the collector is made of a conducting material selected from the group consisting of metals and conducting composites.

15. The apparatus as claimed in claim 1, wherein the spinnerets have interspacing between adjacent nozzles from 10 mm to 100 mm.

16. The apparatus as claimed in claim 1, wherein the spinnerets have interspacing between adjacent rows of the nozzles from 15 mm to 200 mm.

17. The apparatus as claimed in claim 1, wherein the nozzles are made of a conductive or a non conductive material.

18. A method for mass production of nanofibers and for uniform deposition of nanofibers on substrate using the apparatus according to claim 1 comprising the steps of:

preparing a solution of polymer in aqueous or organic solvents;

storing the solution in the at least one reservoir over the plurality of spinnerets with multinozzles provided with the needles for delivering the polymeric solution;

applying an electric field to the needle at a tip of the needle connected with each nozzle by using a connector device such that the charge overcomes a surface tension of a deformed drop of the polymer solution to form nanofibers; and collecting a nanofibrous web from the charged needle tip onto the substrate moving longitudinally over the oppositely charged collector.

* * * * *